US010212509B1

(12) United States Patent
Cardas

(10) Patent No.: US 10,212,509 B1
(45) Date of Patent: Feb. 19, 2019

(54) HEADPHONES WITH AUDIO CROSS-CONNECT

(71) Applicant: George Francis Cardas, Bandon, OR (US)

(72) Inventor: George Francis Cardas, Bandon, OR (US)

( * ) Notice: Subject to any disclaimer, the term of this patent is extended or adjusted under 35 U.S.C. 154(b) by 0 days.

(21) Appl. No.: 15/884,226

(22) Filed: Jan. 30, 2018

Related U.S. Application Data

(60) Provisional application No. 62/451,954, filed on Jan. 30, 2017.

(51) Int. Cl.
*H04R 1/10* (2006.01)
*H04R 3/14* (2006.01)
*H04R 5/033* (2006.01)

(52) U.S. Cl.
CPC ..... *H04R 1/1091* (2013.01); *H04R 1/1008* (2013.01); *H04R 1/1033* (2013.01); *H04R 3/14* (2013.01); *H04R 5/0335* (2013.01)

(58) Field of Classification Search
CPC .. H04R 1/1091; H04R 1/1008; H04R 1/1033; H04R 3/14; H04R 5/0335
See application file for complete search history.

(56) References Cited

U.S. PATENT DOCUMENTS 2,978,543 A * 4/1961 Kennedy ..... H04S 5/00 381/17
6,771,778 B2 * 8/2004 Kirkeby ..... H04S 1/005 381/1
7,065,219 B1 * 6/2006 Abe ..... A61F 11/14 381/74
2002/0186854 A1 * 12/2002 Hosoi ..... H04S 3/008 381/99
2016/0330537 A1 * 11/2016 Barrentine ..... H04R 1/1041

FOREIGN PATENT DOCUMENTS

CN 104363549 A * 2/2015

OTHER PUBLICATIONS

Lehman, Stereo Cross-feed Networks for Headphones, 2015, p. 1-12.*
Grace, m902 Reference Headphone Amplifier/DAC/Monitor Controller—Owners Manual, 2009, p. 1-12.*

* cited by examiner

*Primary Examiner* — Sonia L Gay
(74) *Attorney, Agent, or Firm* — Rylander & Associates, PC; Philip R. M. Hunt

(57) ABSTRACT

An audio cross-connect headphone with an audio cross-connect. A first embodiment has an acoustical cross-connect duct. A second embodiment has a first time delay circuit configured generate a time delayed right stereo signal and mix the time delayed right stereo signal with a left stereo signal, and a second time delay circuit configured to generate a time delayed left stereo signal and mix the time delayed left stereo signal with the right stereo signal. A third embodiment has a Resister-Inductor-Capacitor (RLC) circuit, wherein the right speaker ground wire and left speaker ground wire both split and terminate on a first node of the RLC circuit, then both resume from the second node of the RLC circuit towards the left speaker and right speaker. A fourth embodiment, similar to the third, but the speaker ground wires from the speakers join, but do not connect to the RLC circuit.

3 Claims, 5 Drawing Sheets

HEADPHONES WITH AUDIO CROSS-CONNECT

CROSS-REFERENCE TO RELATED APPLICATION

This application claims the benefit of U.S. Provisional Application No. 62/451,954, filed 2017 Jan. 30, incorporated herein by reference.

TECHNICAL FIELD

This specification relates to headphones. More particularly, the present specification relates to headphones for high fidelity music reproduction.

BACKGROUND

A naturally produced sound emanates from a particular location and is heard by both of the listener's ears. The listener's brain processes the sound information from both ears and is able to determine much information, such the direction the sound is coming from, based on the time-of-arrival difference and sound-pressure-level difference. Stereo recordings and stereo speakers can simulate this to some degree by recording sounds in separated left and right microphones and playing the recorded sounds back in separate left and right stereo speakers. However, with headphones, even stereographic headphones, the stereo method falls short as each ear only hears sounds from a single stereo channel. With non-headphone speakers, sound from each speaker reaches both of the listener's ears.

BRIEF DESCRIPTION OF THE DRAWINGS

The accompanying drawings, which are incorporated into and constitute a part of this specification, illustrate one or more embodiments of the inventive subject matter and, together with the detailed description, serve to explain the principles and implementations thereof. Like reference numbers and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

DETAILED DESCRIPTION

In describing the one or more representative embodiments of the inventive subject matter, use of directional terms such as "upper," "lower," "above," "below", "in front of," "behind," etc., unless otherwise stated, are intended to describe the positions and/or orientations of various components relative to one another as shown in the various Figures and are not intended to impose limitations on any position and/or orientation of any component relative to any reference point external to the Figures.

In the interest of clarity, not all of the routine features of representative embodiments of the inventive subject matter described herein are shown and described. It will, of course, be appreciated that in the development of any such actual implementation, numerous implementation-specific decisions must be made in order to achieve specific goals, such as compliance with application and business related constraints, and that these specific goals will vary from one implementation to another and from one developer to another. Those skilled in the art will recognize that numerous modifications and changes may be made to the representative embodiment(s) without departing from the scope of the claims. It will, of course, be understood that modifications of the representative embodiments will be apparent to those skilled in the art, some being apparent only after study, others being matters of routine mechanical, chemical and electronic design. No single feature, function or property of the representative embodiments is essential. In addition to the embodiments described, other embodiments of the inventive subject matter are possible, their specific designs depending upon the particular application. As such, the scope of the inventive subject matter should not be limited by the particular embodiments herein described but should be defined only by the appended claims and equivalents thereof.

First Representative Embodiment

Figure 1:
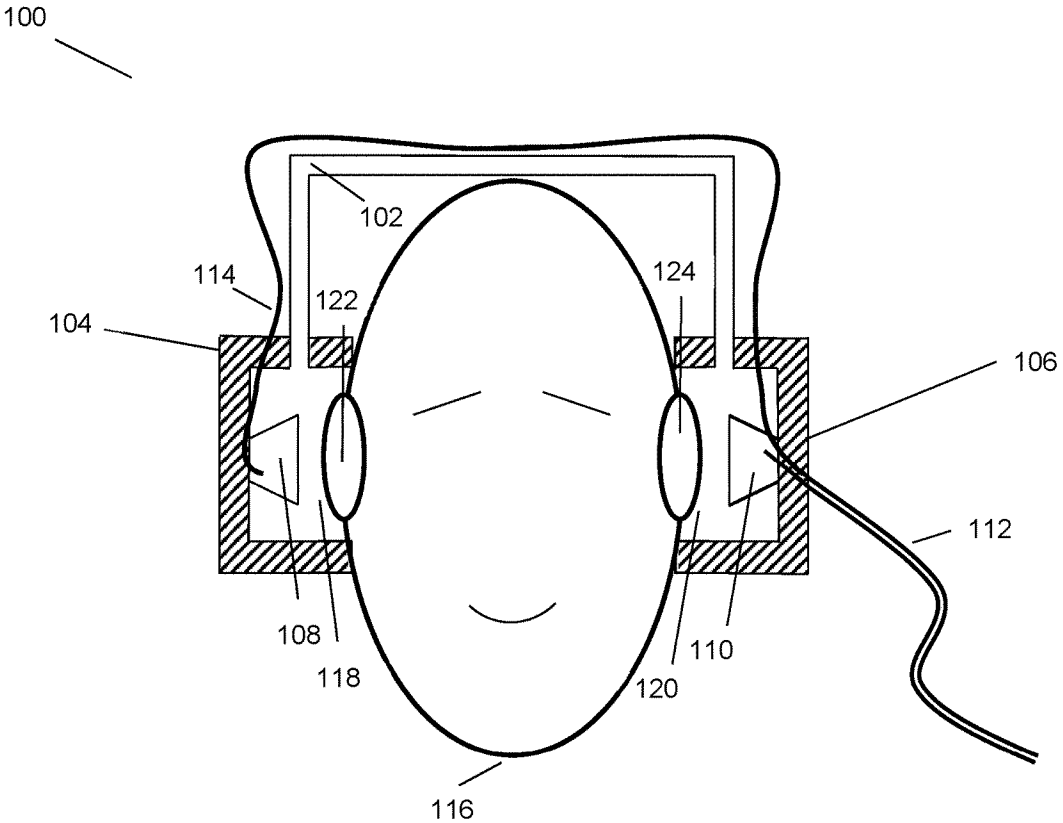
FIG. 1 is a front sectional view of a user wearing the first representative embodiment of an audio cross-connect headphone set.

FIG. 1 show views of a user wearing a first representative embodiment of an audio cross-connect headphone set 100. The audio cross-connect headphone set 100 comprises a right headphone cup 104 and a left headphone cup 106 connected by an acoustical cross-connect duct 102. In the first representative embodiment, the acoustical cross-connect duct 102 also functions as a head band that holds the right headphone cup 104 and left headphone cup 106 in position against a user's head 116. Other embodiments may have a head band separate from the acoustical cross-connect duct 102.

The right headphone cup 104 and left headphone cup 106 are similar to conventional headphone cups, with the right headphone cup 104 configured create an enclosed right headphone cavity 118 next to the user's right ear 122 and the left headphone cup 106 configured to create a left headphone cavity 120 next to the user's left ear 124. A right speaker 108 is attached to the right headphone cup 104 inside the right headphone cavity 118 and a left speaker 110 is attached to the left headphone cup 106 inside the left headphone cavity 120. A conventional stereo left/right speaker cable 112 connects the headphone set 100 with conventional audio signal generating equipment 172. The left stereo signal wires in the left/right speaker cable 112 terminate on the left speaker 110 and the right stereo signal wires in the left/right speaker cable 112 are connected to the right speaker cable 114 and terminate at the right speaker 108. In the first representative embodiment, the right speaker cable 114 runs outside of the acoustical cross-connect duct 102 and may be attached at points along the duct 102. In other embodiments, the right speaker cable 114 may run inside of the acoustical cross-connect duct 102. In alternative embodiments, left and right wiring may be switched, with the left/right speaker cable 112 connects to the right speaker 108 with the left stereo signal wires in the left/right speaker cable 112 continuing on to the left speaker 110.

The acoustical cross-connect duct 102 of the first representative embodiment comprises a plastic tube, cylindrical in cross-section. In other embodiments, the acoustical cross-connect duct 102 may be constructed of other suitable materials and may have other cross-sectional shapes.

Sounds produced by the right speaker 108 travel not only through the right headphone cavity 118 to the user's right ear 122, but through the acoustical cross-connect duct 102 and into the left headphone cavity 120 to the user's left ear 124. Likewise, sounds produced by the left speaker 110 travel through the left headphone cavity 120 to the user's left ear 124, and also through the acoustical cross-connect duct 102 to the right headphone cavity 118 to the user's right ear 122. This results in an experience that is more like listening to conventional room stereo speakers without headphones.

Second Representative Embodiment

Figure 2:
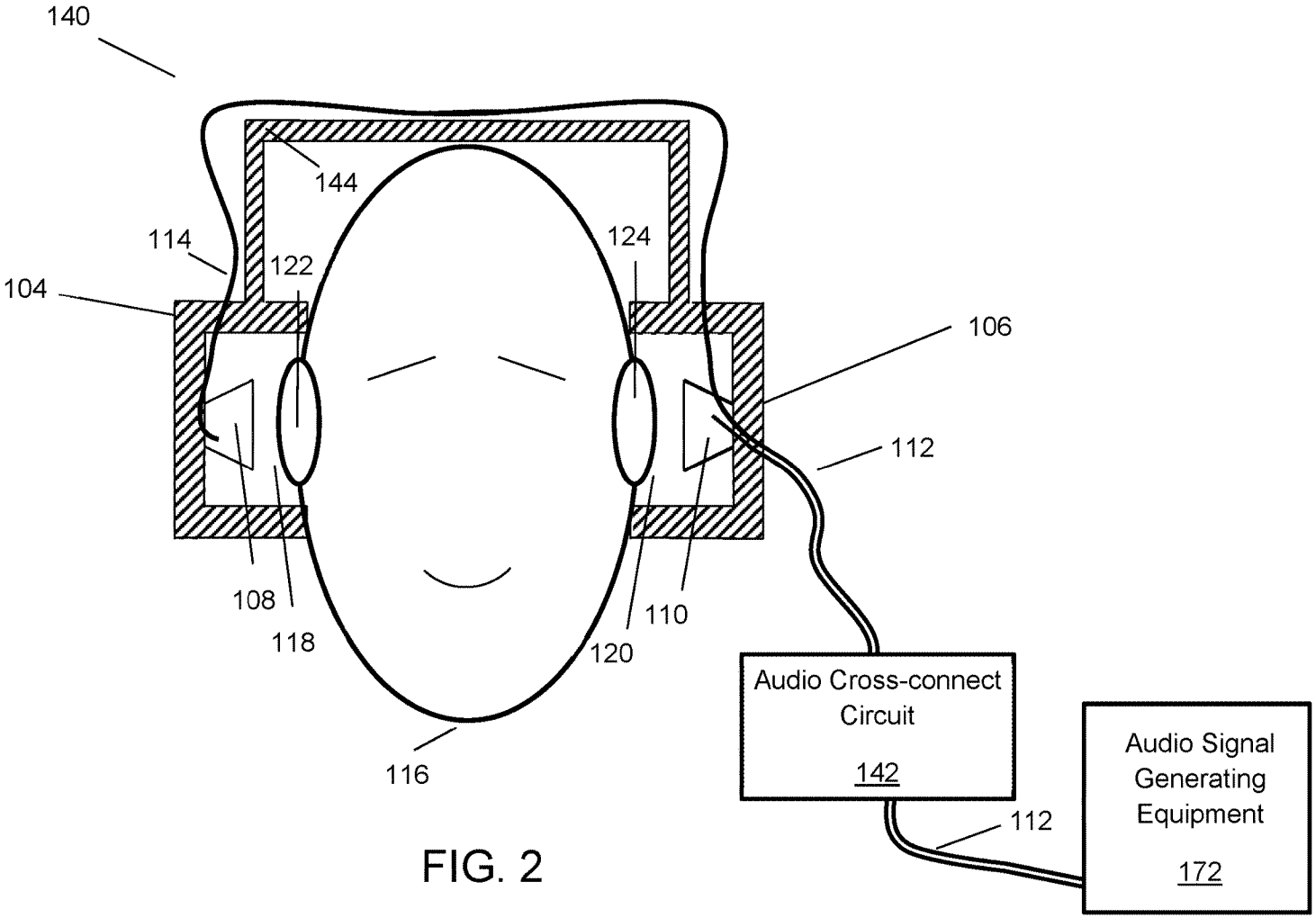
FIG. 2 is a front sectional view of a user wearing a second representative embodiment of an audio cross-connect headphone set.

FIG. 2 shows a view of a user wearing a second representative embodiment of an audio cross-connect headphone set 140. The second embodiment audio cross-connect headphone set 140 comprises a right headphone cup 104 and a left headphone cup 106 connected by a head band 144. The head band 144 does not have any duct for conveying sound between the right headphone cup 104 and left headphone cup 106. Instead of an acoustical cross-connect duct 102 providing the audio cross-connect, the audio cross-connect is provided electronically with an audio cross-connect circuit 142.

Figure 3:
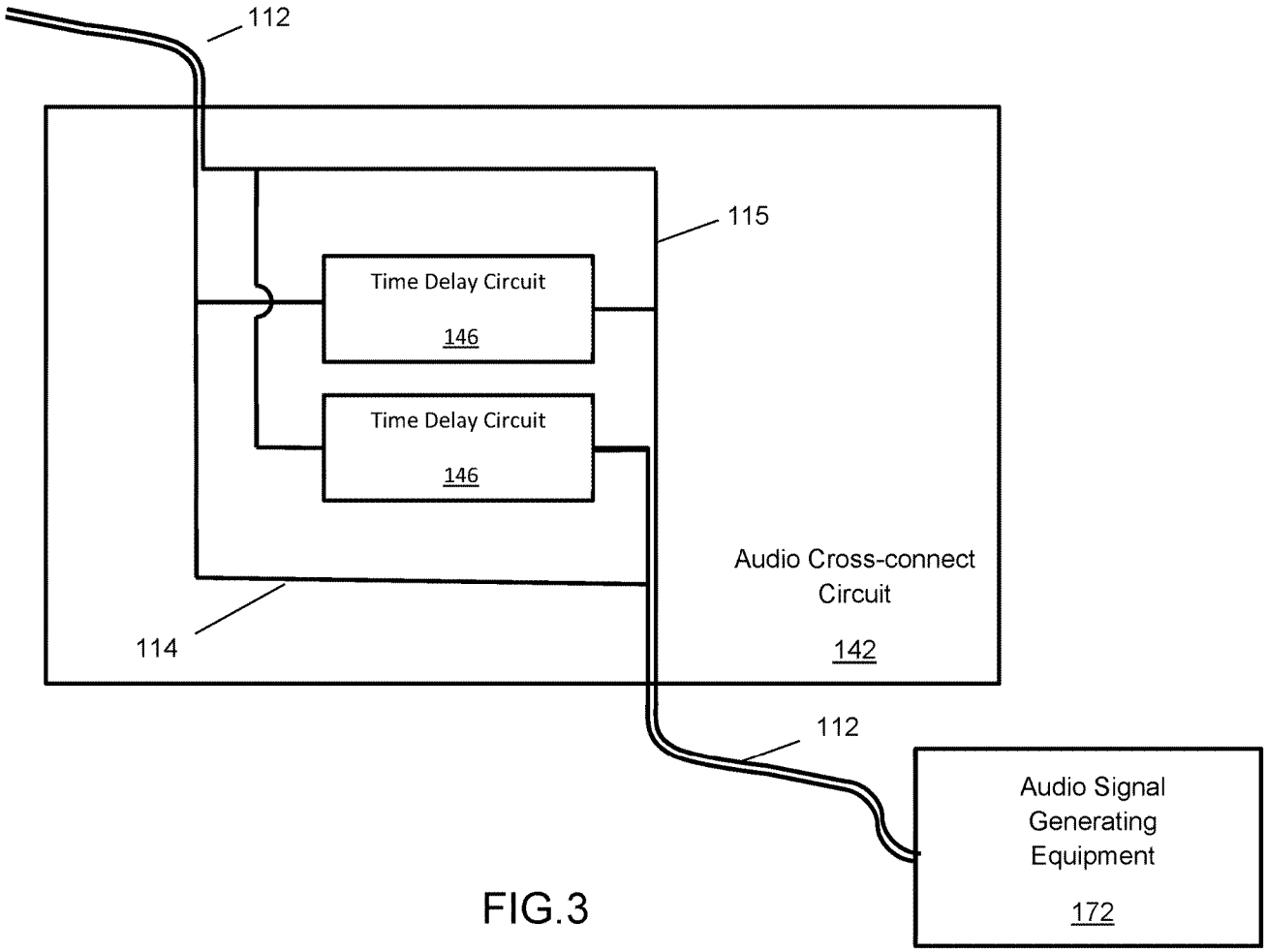
FIG. 3 is a schematic of an audio cross-connect circuit of the second embodiment audio cross-connect headphone set.

FIG. 3 is a schematic of the audio cross-connect circuit of the second embodiment audio cross-connect headphone set 142. The audio cross-connect circuit 142 has two time delay circuits 146. One time delay circuit 146 taps the right stereo signal from the right speaker cable 114, introduces a time delay, then mixes the time delayed right stereo signal with the undelayed left stereo signal on the left speaker cable 115. The other time delay circuit 146 taps the left stereo signal from the left speaker cable 115, introduces a time delay, then mixes the time delayed left stereo signal with the undelayed right stereo signal on the right speaker cable 114. The amount of time delay introduced by the time delay circuits 146 is selected to approximate the amount time it takes sound to travel through the air from one of the user's ears to the other ear. The time delay circuits 146 in the second embodiment are digital, each with an Analog to Digital (A/D) converter, digital time delay circuits, followed by a Digital to Analog (D/A) converter. Other embodiments may uses other digital implementations, or analog implementations.

The audio cross-connect circuit 142 is shown in FIG. 2 as in-line with the left/right speaker cable 112 and physically separate from the left headphone cup 106. However, in other embodiments, the audio cross-connect circuit 142 may be physically coupled to or integrated with the left headphone cup 106. In alternative embodiments, left and right wiring may be switched, with the left/right speaker cable 112 connects to the right speaker 108 with the left speaker cable 115 continuing on to the left speaker 110.

Third Representative Embodiment

Figure 4:
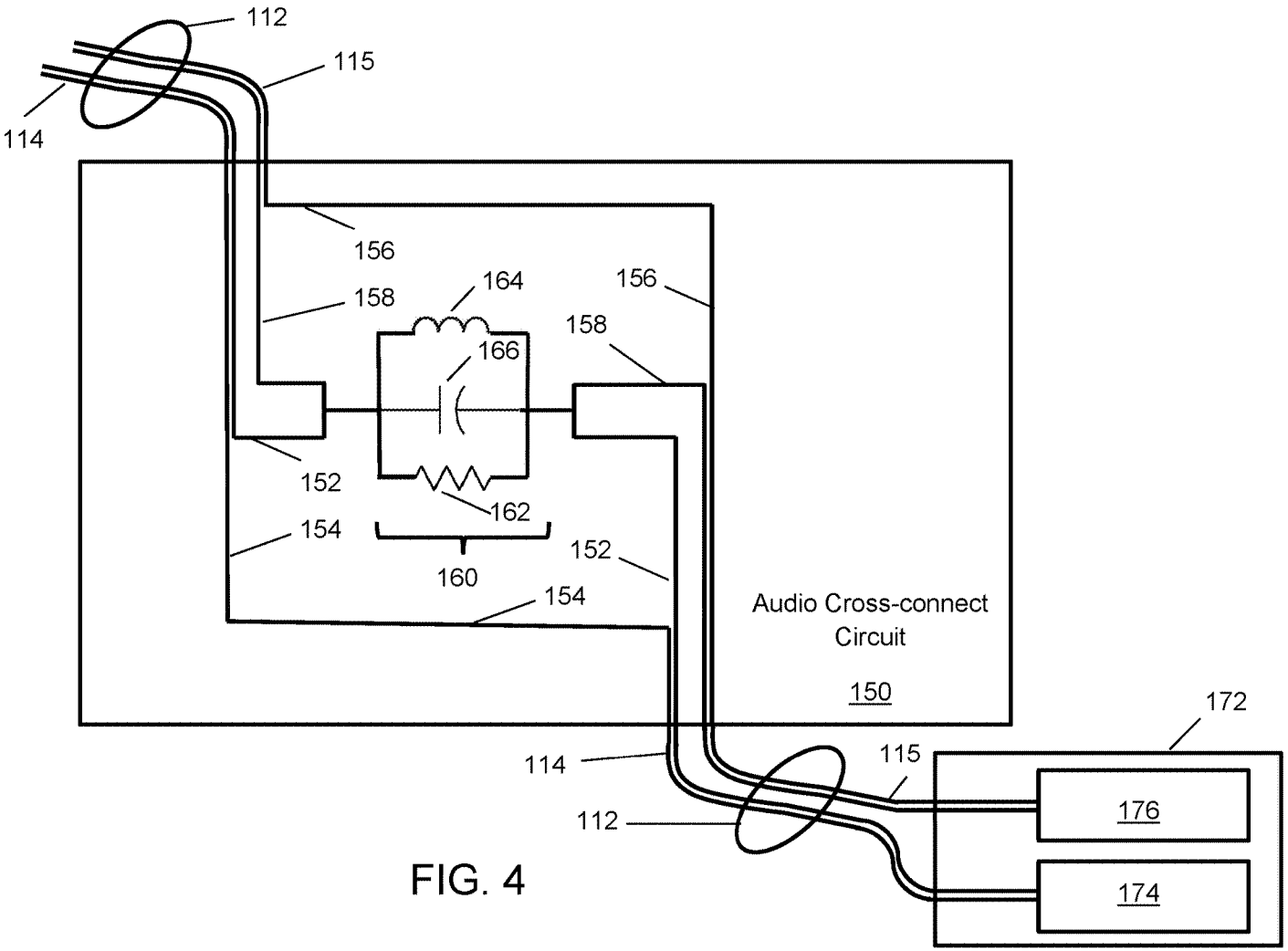
FIG. 4 is a schematic of an audio cross-connect circuit of a third embodiment audio cross-connect headphone set.

FIG. 4 is a schematic of the audio cross-connect circuit 150 of a third embodiment audio cross-connect headphone set. The third embodiment audio cross-connect headphone set is similar to the second embodiment audio cross-connect headphone set 140, but with the third embodiment audio cross-connect circuit 150 instead of the second embodiment audio cross-connect circuit 142. The left/right speaker cable 112 comprises a right speaker cable 114 and a left speaker cable 115. The right speaker cable 114 comprises a right speaker ground wire 152 and a right speaker signal wire 154. Likewise, the left speaker cable 115 comprises a left speaker ground wire 158 and a left speaker signal wire 156. The right speaker signal wire 154 and the left speaker signal wire 156 pass through the third embodiment audio cross-connect circuit 150. The right speaker ground wire 152 and left speaker ground wire 158 enter the third embodiment audio cross-connect circuit 150, then join together in a single line that is connected to one side of a Resister-Inductor-Capacitor (RLC) circuit 160, comprising a resistor 162, an inductor 164 and a capacitor 166 connected in parallel. A single connection leaves the opposite side of the RLC circuit 160, then splits again into continuations of the right speaker ground wire 152 and left speaker ground wire 158. Alternatively, the third embodiment audio cross-connect circuit 150 can be described as the RLC circuit 160 with the resistor 162, the inductor 164 and the capacitor 166 connected in parallel between a first node and a second node. The right speaker ground wire and left speaker ground wire both split. The right speaker ground wire 152 and left speaker ground wire 158 from the audio generating equipment 172 both terminate on the first node of the RLC circuit 160. The right speaker ground wire 152 and left speaker ground wire 158 then both resume from the second node of the RLC circuit 160 towards the left speaker 110 and right speaker 108. While slightly different, these two descriptions are electrically equivalent.

A right stereo signal originating from a right stereo signal amplifier 174 of the audio signal generating equipment 172 enters the third embodiment audio cross-connect circuit 150 on the right speaker signal wire 154, passes through to the right speaker 108, where the signal is converted to sound heard by the user's right ear 122. The right stereo signal then returns on the right speaker ground wire 152, enters the third embodiment audio cross-connect circuit 150, and enters the RLC circuit 160. Part of the right stereo signal passes through and back out of the third embodiment audio cross-connect circuit 150 towards the audio signal generating equipment 172, but part is reflected back towards the speakers. The reflected signal on the right speaker ground wire 152 is canceled by the stronger incoming signal, but passes through the left speaker ground wire 158 to the left speaker 110, where it is converted to sound that is head by the user's left ear 124. A time delay is induced by the time the reflected signal spends in the RLC circuit 160 and traveling to the left speaker 110.

Similarly, a left stereo signal originating from a left stereo signal amplifier 176 of the audio signal generating equipment 172 enters the third embodiment audio cross-connect circuit 150 on the left speaker signal wire 156, passes through to the left speaker 110, where the signal is converted to sound heard by the user's left ear 124. The left stereo signal then returns on the left speaker ground wire 158, enters the third embodiment audio cross-connect circuit 150, and enters the RLC circuit 160. Part of the left stereo signal passes through and back out of the third embodiment audio cross-connect circuit 150 towards the audio signal generating equipment 172, but part is reflected back towards the speakers. The reflected signal on the left speaker ground wire 158 is canceled by the stronger incoming signal, but passes through the right speaker ground wire 152 to the right speaker 108, where it is converted to sound that is head by the user's right ear 122. A time delay is induced by the time the reflected signal spends in the RLC circuit 160 and traveling to the right speaker 108.

Fourth Representative Embodiment

Figure 5:
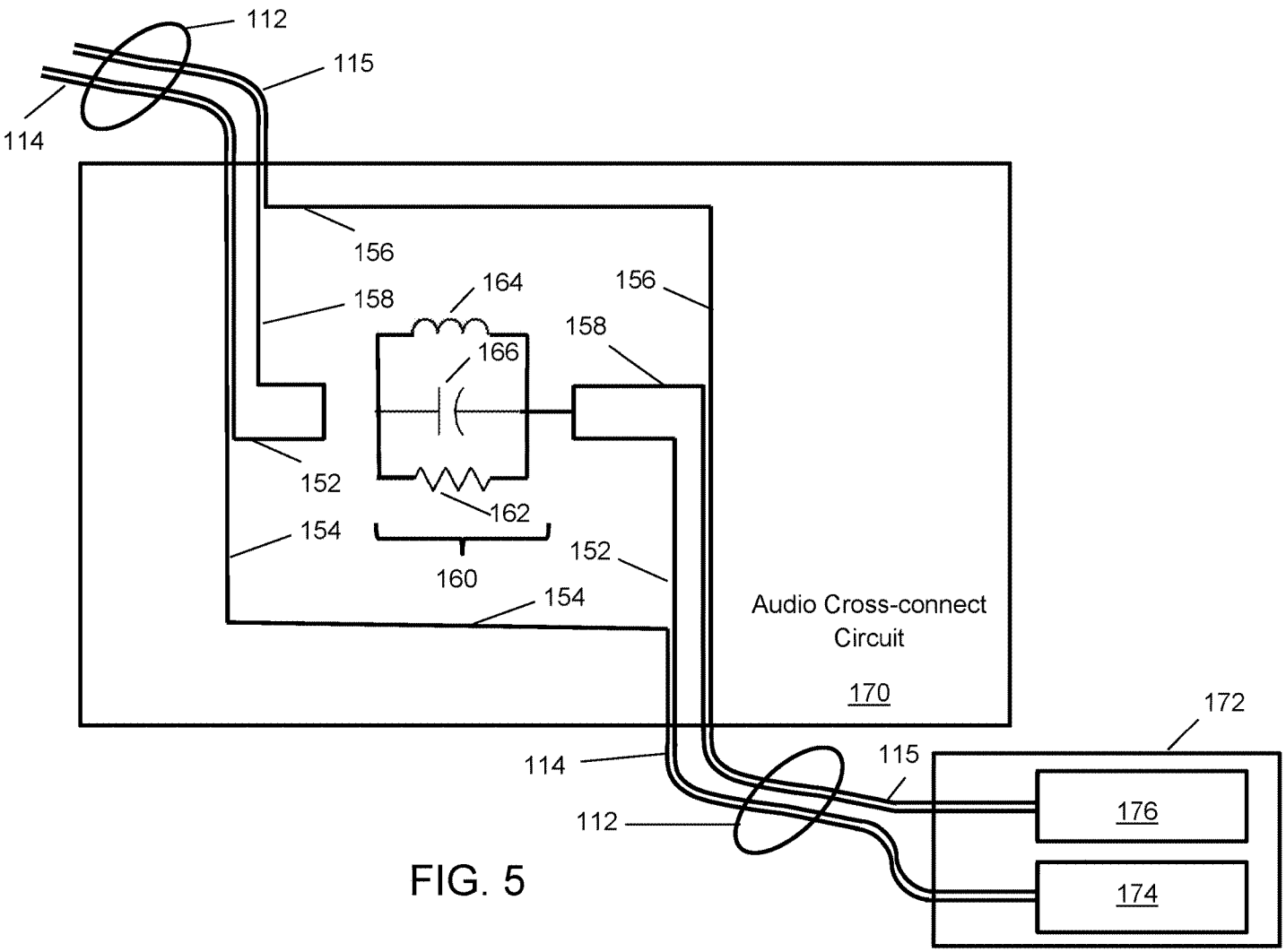
FIG. 5 is a schematic of the audio cross-connect circuit of a fourth embodiment audio cross-connect headphone set.

FIG. 5 is a schematic of the audio cross-connect circuit 170 of a fourth embodiment audio cross-connect headphone set. The fourth embodiment audio cross-connect headphone set is similar to the third embodiment audio cross-connect headphone set, but in the audio cross-connect circuit of the fourth embodiment audio cross-connect headphone set 170 there is no connection to the RLC circuit 160 from the portion of the right speaker ground wire 152 and left speaker ground wire 158 that connect to the right speaker 108 and left speaker 110. There still is a connection to the RLC circuit 160 from the portion of the right speaker ground wire 152 and left speaker ground wire 158 that connect to the audio signal generating equipment 172. Alternatively, the fourth embodiment audio cross-connect circuit 170 can be described as the RLC circuit 160 with the resistor 162, the inductor 164 and the capacitor 166 connected in parallel between a first node and a second node. The right speaker ground wire and left speaker ground wire both split. The right speaker ground wire 152 and left speaker ground wire 158 from the audio generating equipment 172 both terminate on the first node of the RLC circuit 160. The right speaker ground wire 152 and left speaker ground wire 158 towards the left speaker 110 and right speaker 108 are electrically coupled together in a loop back, but do not electrically couple to the second node of the RLC circuit 160. While slightly different, these two descriptions are electrically equivalent.

Both the right speaker 108 and left speaker 110 receive right stereo signal traveling in one direction and left stereo signal traveling in the opposite direction and both speakers reproduce sound based on the difference of these signals. If the RLC circuit 160 were not in the circuit, the sum of these signals would be subtracted. With the RLC circuit 160 connected to the portion of the right speaker ground wire 152 and left speaker ground wire 158 that connect to the audio signal generating equipment 172, the sum of the signals ("center channel" information) is restored. The sum of the signals is separate from the delayed difference information. The delayed difference information is provided by the pathway through the right speaker 108 and left speaker 110. The drivers of the right speaker 108 and left speaker 110 are wound to provide a substantial inductance that requires each driver cone to be loaded before the signal is passed to the opposite driver.

What is claimed is:

1. An audio cross-connect headphone set comprising:

a headband;

a left headphone cup coupled to the headband;

a right headphone cup coupled to the headband;

a left speaker coupled to the left headphone cup;

a right speaker coupled to the right headphone cup;

a left/right speaker cable with a left speaker cable and a right speaker cable, wherein the left speaker cable is electrically coupled to the left speaker, the left speaker cable configured for carrying a left stereo signal from audio signal generating equipment to the left speaker, wherein the right speaker cable is electrically coupled to the right speaker, the right speaker cable configured for carrying a right stereo signal from the audio signal generating equipment to the right speaker, the left speaker cable having a left speaker signal wire and a left speaker ground wire, the right speaker cable having a right speaker signal wire and a right speaker ground wire;

an audio cross-connect circuit; and wherein the audio cross-connect circuit has a Resister-Inductor-Capacitor (RLC) circuit, wherein the RLC circuit comprises a resistor, an inductor and a capacitor connected in parallel between a first node and a second node, wherein the right speaker ground wire and left speaker ground wire both split, wherein the right speaker ground wire and left speaker ground wire from the audio signal generating equipment both terminate on the first node of the RLC circuit, wherein the right speaker ground wire and left speaker ground wire both resume from the second node of the RLC circuit towards the left speaker and right speaker.

2. An audio cross-connect headphone set comprising:

a headband;

a left headphone cup coupled to the headband;

a right headphone cup coupled to the headband;

a left speaker coupled to the left headphone cup;

a right speaker coupled to the right headphone cup;

a left/right speaker cable with a left speaker cable and a right speaker cable, wherein the left speaker cable is electrically coupled to the left speaker, the left speaker cable configured for carrying a left stereo signal from audio signal generating equipment to the left speaker, wherein the right speaker cable is electrically coupled to the right speaker, the right speaker cable configured for carrying a right stereo signal from the audio signal generating equipment to the right speaker, the left speaker cable having a left speaker signal wire and a left speaker ground wire, the right speaker cable having a right speaker signal wire and a right speaker ground wire;

an audio cross-connect circuit; and wherein the audio cross-connect circuit has a Resister-Inductor-Capacitor (RLC) circuit, wherein the RLC circuit comprises a resistor, an inductor and a capacitor connected in parallel between a first node and a second node, wherein the right speaker ground wire and left speaker ground wire both split, with the right speaker ground wire and left speaker ground wire from the audio signal generating equipment both terminate on the first node of the RLC circuit, wherein the right speaker ground wire and left speaker ground wire from the left speaker and right speaker are electrically coupled in a loop back.

3. The audio cross-connect headphone set of claim 2, wherein the right speaker ground wire and left speaker ground wire from the left speaker and right speaker do not directly electrically couple to the RLC circuit.

* * * * *